US006882117B1

(12) United States Patent
Hughes et al.

(10) Patent No.: US 6,882,117 B1
(45) Date of Patent: Apr. 19, 2005

(54) APPARATUS AND METHODS FOR CONTINUOUS AND/OR SELECTIVE PRODUCTION OF MULTIPLE LIGHT DISPLAYS

(76) Inventors: Thomas A. Hughes, 181 Monroe, Eugene, OR (US) 97402; Matthew E. Anderson, 9644 Sierra Vista, La Mesa, CA (US) 91941

( * ) Notice: Subject to any disclaimer, the term of this patent is extended or adjusted under 35 U.S.C. 154(b) by 69 days.

(21) Appl. No.: 10/355,400

(22) Filed: Jan. 31, 2003

Related U.S. Application Data

(60) Provisional application No. 60/355,633, filed on Feb. 5, 2002.

(51) Int. Cl.[7] ..... H05B 41/36

(52) U.S. Cl. ..... 315/291; 315/360; 362/227

(58) Field of Search ..... 315/76, 360, 291, 315/307; 362/227, 230–231, 234, 236, 251

(56) References Cited

U.S. PATENT DOCUMENTS

| | | | | |
|---|---|---|---|---|
| 4,038,611 A | | 7/1977 | Greig | 331/108 D |
| 4,298,868 A | | 11/1981 | Spurgeon | 345/31 |
| 4,754,202 A | | 6/1988 | Havel | 315/169.1 |
| 4,810,937 A | | 3/1989 | Havel | 315/152 |
| 5,032,098 A | | 7/1991 | Balogh et al. | 446/47 |
| 5,057,827 A | | 10/1991 | Nobile et al. | 345/31 |
| 5,066,929 A | | 11/1991 | Frantz | 331/57 |
| 5,145,444 A | | 9/1992 | VanKuiken | 446/242 |
| 5,406,300 A | | 4/1995 | Tokimoto et al. | 345/31 |
| 5,418,697 A | | 5/1995 | Chiou | 362/473 |
| 5,844,377 A | * | 12/1998 | Anderson et al. | 315/251 |
| 6,016,038 A | | 1/2000 | Mueller et al. | 315/291 |
| 6,106,135 A | * | 8/2000 | Zingale et al. | 362/186 |
| 6,239,774 B1 | | 5/2001 | Altman | 345/31 |
| 6,371,638 B1 | * | 4/2002 | Zingale et al. | 362/565 |

* cited by examiner

*Primary Examiner*—Thuy Vinh Tran
(74) *Attorney, Agent, or Firm*—David S. Alavi

(57) ABSTRACT

An apparatus for producing multiple light displays comprises: a discrete light source emitting at least one primary color; a circuit for driving the light source; a flexible tether secured to the light source; a handle secured to the flexible tether; and a control actuator. The drive circuit produces each of multiple time-dependent drive signals. The handle enables a user to move the light source along a curvilinear path at the end of the tether, the time-dependent drive signal and movement of the light source together producing the light display. The control actuator enables the user, while moving the light source along the curvilinear path and without substantially interrupting movement of the light source, to (i) alter the time-dependence of the drive signal and/or (ii) select another of the time-dependent drive signals for driving the light source, thereby altering the light display.

32 Claims, 4 Drawing Sheets

APPARATUS AND METHODS FOR CONTINUOUS AND/OR SELECTIVE PRODUCTION OF MULTIPLE LIGHT DISPLAYS

RELATED APPLICATIONS

This application claims benefit of prior-filed co-pending provisional App. No. 60/355,633 entitled "Kinetic light machine for the continuous and selective production of distinctive light displays" filed Feb. 5, 2002 in the names of Thomas Abbott Hughes and Matthew Edward Anderson, said provisional application being hereby incorporated by reference as if fully set forth herein.

BACKGROUND

The field of the present invention relates to machines which produce light displays, specifically to those machines that utilize both movement of a light source and the phenomenon of persistence of vision to produce visually striking, intriguing, and/or pleasing light displays.

This application may be related to subject matter disclosed in:

U.S. Pat. No. 5,844,377 entitled "Kinetically multicolored light source" issued Dec. 01, 1998 to Matthew E. Anderson and Thomas A. Hughes;

U.S. Pat. No. 6,239,774 entitled "Persistent image maker" issued May 29, 2001 to Altman;

U.S. Pat. No. 6,016,038 entitled "Multicolored LED lighting method and apparatus" issued Jan. 18, 2000 to Mueller et al;

U.S. Pat. No. 5,418,697 entitled "Signal lamp assembly for bicycles" issued May 23, 1995 to Chiou;

U.S. Pat. No. 5,406,300 entitled "Swing type aerial display system" issued Apr. 11, 1995 to Tokimoto et al;

U.S. Pat. No. 5,145,444 entitled "Strobe light effect yo-yo" issued Sep. 18, 1992 to Vankuiken;

U.S. Pat. No. 5,066,929 entitled "Circuit for producing four indications on a bicolor light emitting diode having two leads" issued Nov. 19, 1991 to Frantz;

U.S. Pat. No. 5,057,827 entitled "Means and method for producing an optical illusion" issued Oct. 15, 1991 to Nobile et al;

U.S. Pat. No. 5,032,098 entitled "Illuminated flying disk" issued Jul. 16, 1991 to Balogh et al;

U.S. Pat. No. 4,810,937 entitled "Multicolor optical device" issued Mar. 7, 1989 to Havel;

U.S. Pat. No. 4,754,202 entitled "Multicolor comparison display" issued Jun. 28, 1988 to Havel;

U.S. Pat. No. 4,298,868 entitled "Electronic display apparatus" issued Nov. 3, 1981 to Spurgeon; and U.S. Pat. No. 4,038,611 entitled "Variable on- and off-time relaxation oscillator" issued Jul. 26, 1977 to Greig.

Displays of brightly colored light have almost universal appeal, and the development of techniques for their production has absorbed much inventive effort. At the opposite end of the size spectrum from fireworks displays and laser light shows, there are many machines that enable the production of small, person-sized light displays. A study of the smaller devices reveals a number of schemes for making colored light appear to emanate from various points in space. These displays, being generated for the benefit of humans, typically exploit various of the known characteristics of the human visual system.

The effectiveness of many light displays rests upon the phenomenon of persistence of vision, that is, the visual memory that persists for a moment after the associated visual stimulus has been removed. Thus a light source rapidly moved within an otherwise darkened room will cause a bright trace to persist in the vision of an observer after the passing of the light source. This phenomenon can be exploited with any light source having adequate contrast against its background, but the images are most striking when a variety of colors and stroboscopic effects are used. Furthermore, images appearing to be extended, multidimensional, illuminated displays can thereby be produced with only a small number of discrete but rapidly moving light sources.

A light source capable of producing light of only a few primary colors may be made to appear to emit a nearly infinite range of secondary colors by rapid oscillation between two or more primary colors; if the light source does not move with respect to the observer's field of vision, at oscillation frequencies above 10 Hz, a constant, secondary color will be observed. This is another exploitation of the phenomenon of persistence of vision. An example of such a device is described in U.S. Pat. No. 5,066,929, which discloses a light source comprising a pair of LED's each emitting a primary color and both contained in a single contiguous translucent housing. By connecting the LED's in parallel with opposite polarities and applying an alternating signal across them at sufficiently high frequencies, both primary colors are alternately produced but appear to a human observer as a single secondary color. The relative contributions from each of the two primary colors to the secondary color are dependent upon the duty cycle and the amplitude of the alternating drive signal, and the electrical response of the LED's. By varying the drive signal, the secondary color may be continuously varied.

When a light source alternately pulsing at least two primary colors to produce the visual effect of a constant secondary color moves with sufficient speed across an observer's field of view, the secondary color appears to separate into its constituent primary colors. More specifically, each primary color will produce a streak of color that persists momentarily in the observer's vision and the secondary color will no longer be apparent. This occurs whenever the pulsating light source moves fast enough that the distances traveled during an "on" cycle of a primary color are visually resolvable. This effect can be used to generate a kinetically multicolored light source which appears to emit a constant secondary color when stationary and multiple primary colors when moving (as in U.S. Pat. No. 5,844,377).

Machines that rely on persistence of vision in order to make operator-selectable or operator-controllable light displays must address the problems of how to simultaneously move and power the light sources and how to provide the operator with control over the delivery of power to those sources. The motion of the light sources must be fairly rapid (depending upon the desired visual effect) and the control element typically requires a number of electrical connections to the moving light sources. These problems may be solved with rigid mechanical members moving the light sources and brush-type electrical contacts, but such a solution is expensive and cumbersome. If a particular display is desired, there must be controls to synchronize the light emission with the motion of the light sources. This may be achieved with brush-type connections, with acceleration-sensing devices, or with some other form of feedback from the light source. However, this may contribute heft and/or complexity to the device, and generally increase the manufacturing cost. There must also be an operator interface allowing the operator to control the light display. It is best that this control be exercisable even as the machine moves and that associated requisite manipulations, such as pushing buttons or moving sliding switches, be uncomplicated.

Application of the above techniques to the production of light displays are described in a number of U.S. Patents. Two relatively complicated machines, which include rotating parts and brush-type electrical connections, are described in U.S. Pat. Nos. 5,057,827 and 4,298,868. These machines generate a large number of light displays, but their use is restricted by their bigger-than-pocket size, mechanical and electrical complexity, and associated manufacturing cost. U.S. Pat. Nos. 5,844,377, 5,406,300, and 6,239,774 describe hand-held devices which generate light displays when a light-emitting component is simply waved through the air. These do not disclose an inexpensive electronic means for generating a large number of many-colored light displays: Pat. No. 5,844,377 does not disclose any electronic means for the operator to control the production of light displays; Pat. Nos. 5,406,300 and 6,239,774 discuss the production of specific images as opposed to colorful and attractive patterns and do not disclose a suitable interface for the production of numerous colorful displays. U.S. Pat. Nos. 5,145,444, 5,418,697, and 5,032,098 describe the mounting of a light source onto a "yo-yo", bicycle wheel, or flying disk, respectively, in order to generate the movement required for a persistence-of-vision-type light display; though these inventions may produce many distinctive and colorful displays, they lack a means for an operator to control the production of light while the machine is in motion, so an operator-controlled, uninterrupted production of a series of changing light displays is not possible.

Machines for producing colorful light displays which include a moving light source and rely on the phenomenon of persistence of vision to create an appealing visual effect typically include an electric circuit which powers the light source in a time dependent manner. The specifics of the generated light display are dictated by the simultaneous driving and moving of the light source. There are continuing efforts to produce light displays with ever greater visual appeal and to reduce the cost of the associated driving circuitry.

SUMMARY

An apparatus for producing multiple light displays comprises: at least one discrete light source emitting at least one primary color; a drive circuit for driving the light source; a flexible tether secured near a first end thereof to the light source; a handle, secured to the flexible tether near a second end thereof; and a control actuator. The drive circuit may be encoded with instructions for producing each of a plurality of time-dependent drive signals for driving the light source. The handle enables a user to move the light source along a curvilinear path at the end of the tether, the time-dependent drive signal and movement of the light source together producing one of the multiple light displays. The control actuator enables the user, while moving the light source along the curvilinear path and without substantially interrupting movement of the light source, to perform at least one of (i) altering the time-dependence of the drive signal and (ii) selecting another of the plurality of time-dependent drive signals for driving the light source, thereby altering the light display.

A method for producing multiple light displays comprises: providing to a user an apparatus as set forth in the preceding paragraph; instructing the user to hold the handle, activate the light source, and move the light source along a curvilinear path, thereby producing one of the multiple light displays; and instructing the user to actuate the control actuator while moving the light source along the curvilinear path, thereby altering the light display without substantially interrupting movement of the light source.

The drive circuit may be located in the handle, with a wire running along the flexible tether between the drive circuit and the light source. The control actuator may be located on the handle. The light source may emit light in one or more primary colors, and may comprise a plurality of light-emitting elements arranged so that multiple emitted primary colors may appear to a human observer as a secondary color. Each time-dependent drive signal may comprise a repeated drive motif or a combination of two or more repeated primary drive motifs, at least one of the primary drive motifs comprising temporal intervals during which light appears to be emitted at differing brightness levels (which may include no apparent emission during one or more of the intervals). The drive circuit may be adapted for altering and/or switching motifs in response to user actuation of the control actuator, thereby enabling the user to alter the light display without substantially interrupting movement of the light source along the curvilinear path.

Objects and advantages of the present invention may become apparent upon referring to the disclosed embodiments as illustrated in the drawings and disclosed in the following written description and/or claims.

Figure 1:
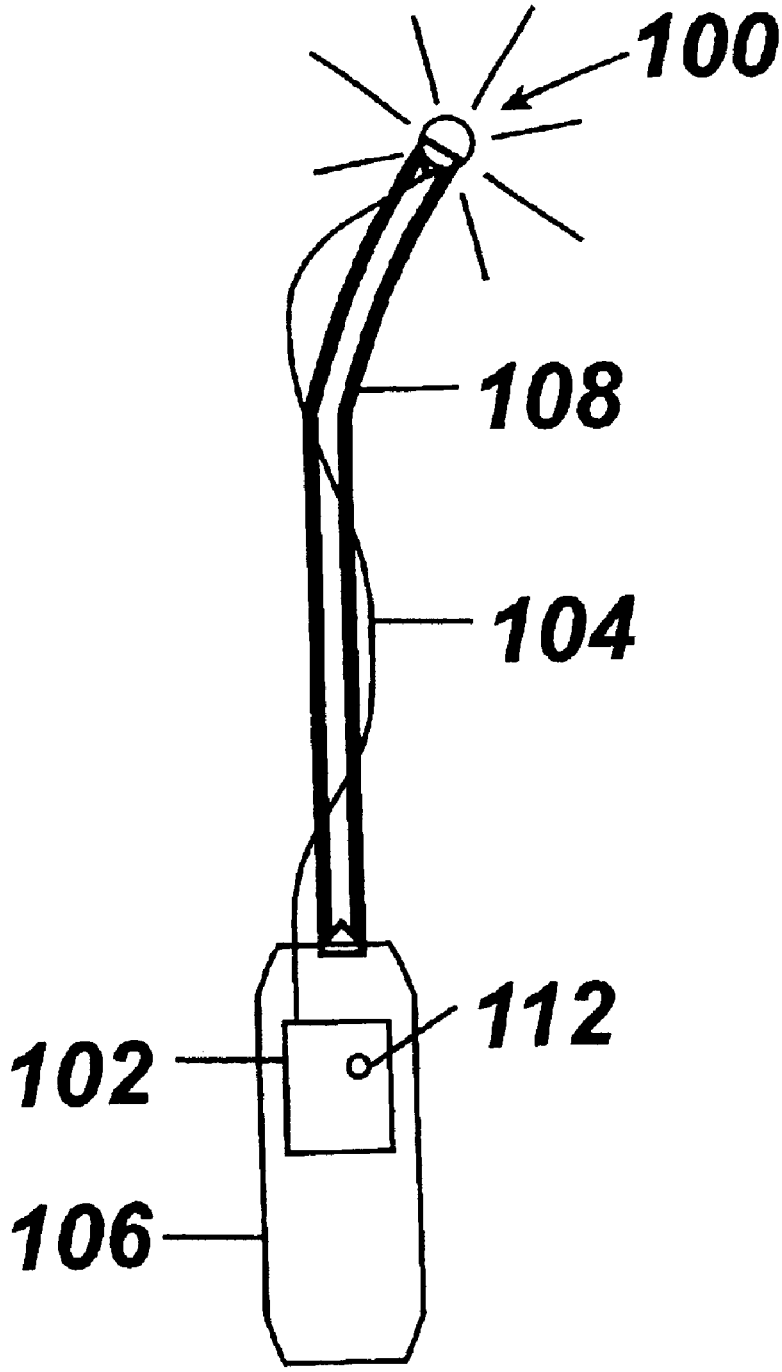
FIG. 1 is a schematic diagram showing an exemplary apparatus for producing multiple light displays.

Reference numerals in the Drawings: 100—light source; 102—driving circuit; 104—four-conductor wire; 106—handle/circuit enclosure; 108—flexible nylon tether; 110—trajectory; 112 momentary push-button; 300—motif; and 302—colored segments The embodiments shown in the Figures are exemplary, and should not be construed as limiting the scope of the present disclosure and/or appended claims.

DETAILED DESCRIPTION OF EMBODIMENTS

FIG. 1 shows a schematic diagram of an exemplary embodiment of an apparatus for producing multiple light displays. A discrete light source 100 is a three-primary-color light-emitting diode (LED) (Nichia NSTM51 5AS) containing red, green, and blue light-emitting diode elements in a contiguous translucent housing. The term "primary" does not indicate any particular color or group of colors, but is used to describe those unmixed colors emitted by a single light-emitting element within a light source. Light source 100 is electrically connected to a driving circuit 102 with a four-conductor wire 104 whereby each of the diodes can be driven independently. Light source 100 is also connected to a handle/circuit-enclosure 106 by a flexible nylon tether 108 which may have a length between about 5 cm and about 100 cm, typically between about 10 cm and about 30 cm, or near about 20 cm. A momentary push-button 112 serves as a control actuator for driving circuit 102 as explained below. Button 112 is located so it may be conveniently manipulated while a human operator keeps the machine in motion.

Figure 2:
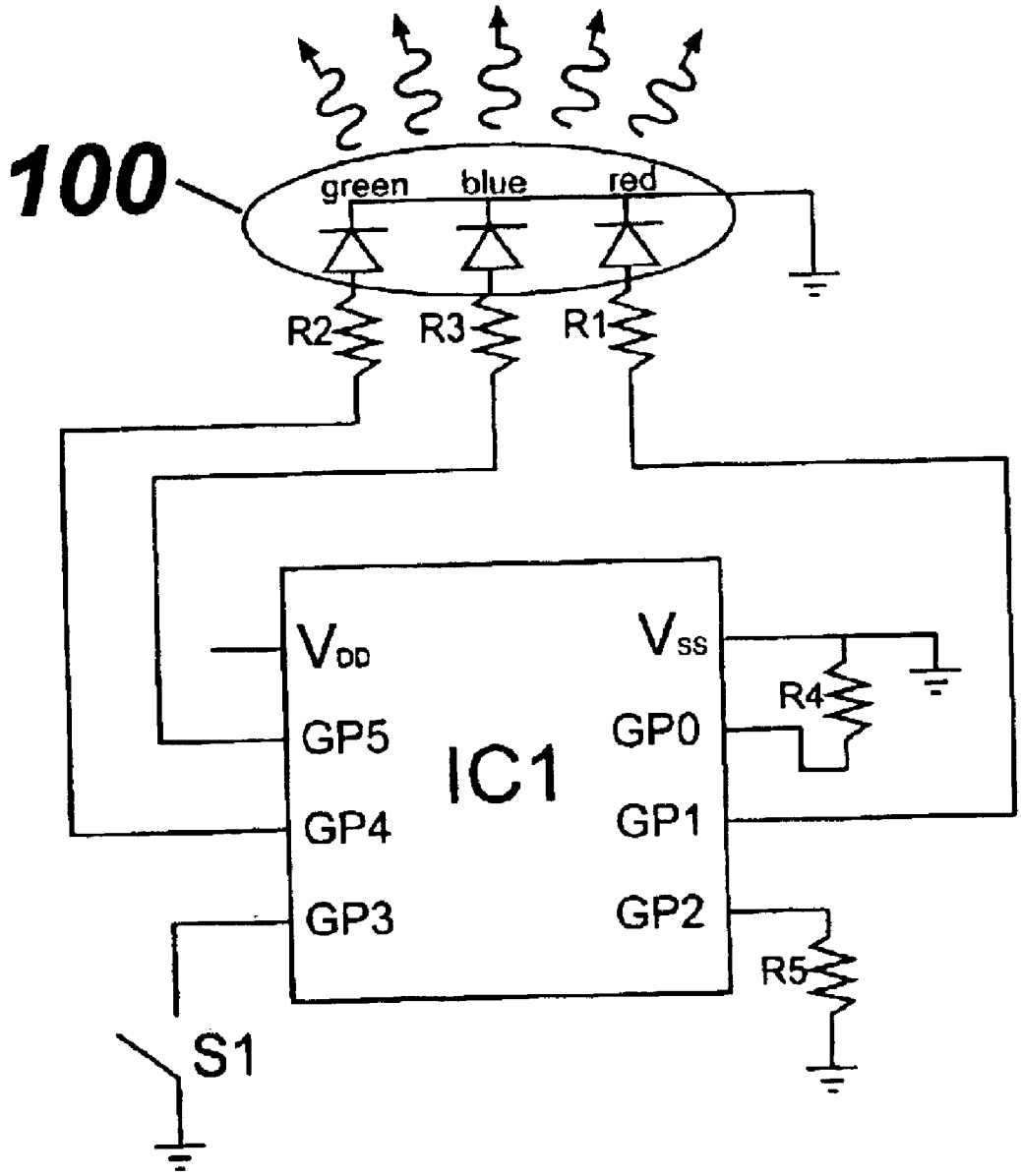
FIG. 2 is a schematic diagram of an exemplary drive circuit for an apparatus for producing multiple light displays.

FIG. 2 shows exemplary electronic circuitry for controlling power transfer to the light source of the apparatus of FIG. 1. Three general-purpose input/output pins GP1, GP4, and GP5 of micro-controller IC1 (Microchip PIC508A) respectively drive the red, green, and blue LED's contained in light source 100 through three current limiting resistors R1, R2, and R3. The voltage at pin $V_{DD}$ of IC1 may be any sufficiently constant voltage from between about 2.5V and about 6V, typically about 5 Volts, and may be maintained by any suitable electrical power supply such as 4 AA sized NiCd batteries connected in series (not shown) or any other suitable battery or battery pack. Pins GP0 and GP2 are not used in this example; R4 and R5 protect these pins from damage by electrostatic discharge. The exemplary hexadecimal machine code of Appendix 1 is loaded into the program memory of IC1. The code includes instructions to generate a total of 96 driving patterns from 12 sets of data. Each driving pattern consists of a periodically repeating sequence of pulses that drives the three LED's. A switch S1 may be momentarily closed to control the execution of the instructions loaded in the program memory of IC1 and thereby change the active driving pattern as explained below. Switch S1 indicates the electronic action of button 112 in FIG. 1; pushing button 112 in FIG. 1 is equivalent to closing switch S1 in FIG. 2.

Light source 100 may, in principle, produce an apparently continuous range of colors. Due to the mutual proximity of the LED's, the translucency of their housing, and the phenomenon of persistence of vision, an apparent secondary color of light emitted by light source 100 is a function of the relative brightness levels of emitted primary colors. Differing brightness levels may be achieved in any suitable manner, including variation of the amplitude or magnitude of a drive signal, and/or variation of a duty cycle of an alternating or oscillatory drive signal, or by other suitable methods. For example, by applying a corresponding oscillatory primary drive signal to each of the LED's (at frequencies greater than about 7 kHz and with varying duty cycles), a variety of secondary colors that are mixtures of the primary colors of red, green, and blue are produced. When emitted, secondary colors may appear to be emitted substantially continuously over a given temporal interval, even at high speeds of motion of light source 100. This effect is utilized in the circuit of FIG. 2 to produce 15 different colors. Slower oscillatory drive signals may be employed for producing primary and/or secondary colors that do not appear to be emitted continuously, but may flicker or flash or appear grainy. Both fast and slow oscillatory drive signals may be employed for producing various light displays while remaining within the scope of the present disclosure and/or appended claims.

Figure 3:
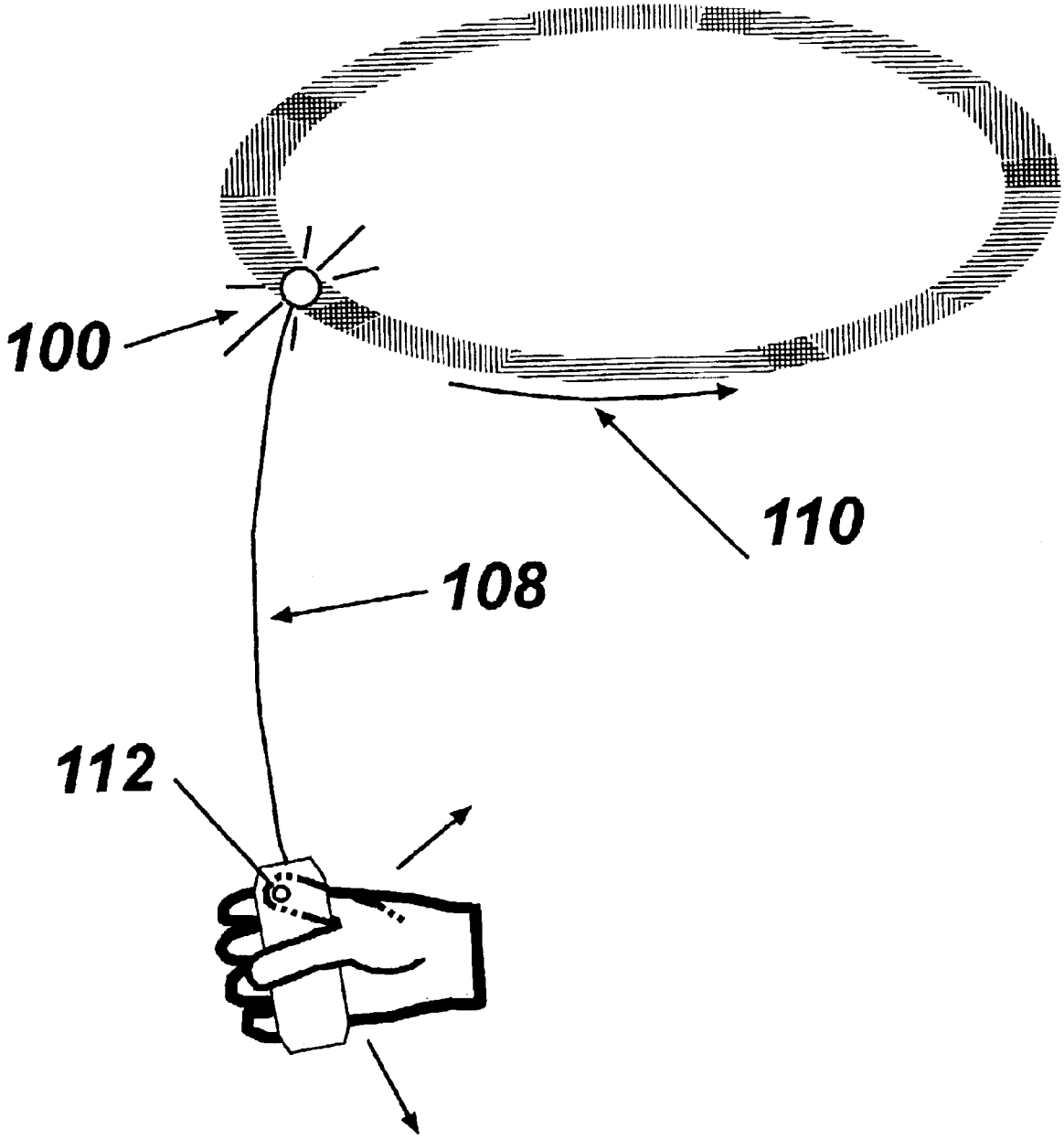
FIG. 3 illustrates exemplary operation of an apparatus for producing multiple light displays.

FIG. 3 shows the exemplary apparatus of FIG. 1 in motion. Hand motions of the operator cause the light source to move along a curvilinear path within the constraints of tether 108. FIG. 3 shows that slight hand motions, most preferably of a periodic or oscillatory nature, cause light source 100 to travel along a curvilinear trajectory 110. Light source 100 can be moved with a range of speeds along innumerable trajectories: it may move along an arc, along a "figure 8", along an ellipse, along a circle, or along any generalized curvilinear path which may be open or closed; it may travel at speeds above 5 meters per second, or move very slowly; tether 108 may move as does a whip, causing light source 100 to briefly move at very high speeds. Movements of light source 100 are limited only by the length and flexibility of tether 108 and the range and speed of the operator's hand motions. The operator can activate any one of the 96 driving patterns while the light machine is in motion by pushing button 112, as indicated. When a driving pattern is active while light source 100 travels as in FIG. 3, a light display is generated.

Figure 4:
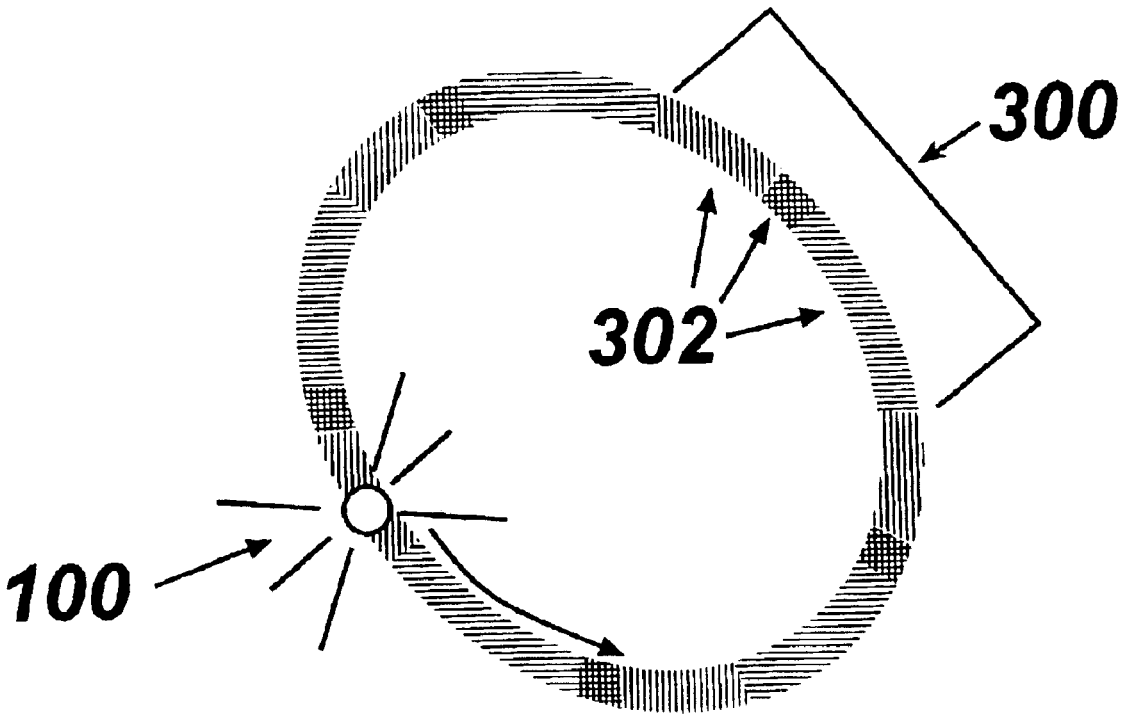
FIG. 4 is a schematic diagram of an exemplary light display generated with an apparatus for producing multiple light displays.

FIG. 4 schematically illustrates an exemplary light display wherein a motif 300, containing an arrangement of segments 302 of various colors, brightness levels, and/or lengths is repeated along one of the many possible curvilinear paths of light source 100. As discussed above, the phenomenon of persistence of vision causes segments 302 to appear to momentarily coexist. The light display is defined by: the curvilinear path along which light source 100 travels; the colors, brightness levels, and lengths of constituent segments 302; and the arrangement or order of the segments along the curvilinear path. A boundary between adjacent segments may be abrupt or may be a smooth transition, depending on the time-dependence of the driving signals employed. Colors, lengths, and brightness levels may appear substantially continuous or may appear grainy, depending on frequencies of oscillatory drive signals employed. For the exemplary embodiment of FIG. 4, the driving pattern is the combination of three primary drive signals, each corresponding to one of the primary colors. Thus FIG. 4 may represent the combined effect of two or more primary drive signals, at least one of which is time-dependent. By varying his/her hand motion, a user may produce numerous light displays from a given time-dependent drive signal. Each time-dependent drive signal is thereby associated with a set of light displays; selecting a new time-dependent driving pattern allows production of a new set of light displays. Many light displays generated with the apparatus are substantially analogous to the light display depicted in FIG. 4, in that they will appear as one or more bright segments (short segments may look like points) arranged along a curvilinear path; a motif may or may not be apparent, according to its period of repetition and the particular movement of light source 100.

The operator may activate various time-dependent drive signals (equivalently, driving patterns) in the exemplary embodiment as follows. With the circuit in the powered down state, pushing button 112 in FIG. 1 for approximately 0.2 seconds and then releasing it switches the circuit to a powered up state and selects a driving pattern utilizing the first of the 12 data sets. Moving light source 100 as in FIG. 3 will now generate a light display as indicated in FIG. 4. Pushing button 112 in FIG. 1 for about 1 second and then releasing it will cause the segments of which the current light display consists to individually lengthen, shorten, or be unchanged; the response of each segment is programmed in IC1; the color of each segment will not change, so the light displays will be somewhat similar in appearance. Such similar or related light displays are generated by incrementing control registers in IC1 and thereby affecting the length of time spent in various of the loops within the code of Appendix 1. If button 112 is again given an about-1-second-long push, the segments will retain their length as of this second pushing of button 112. The operator can use about-1-second-long pushes to toggle between these two display modes: in the first mode, every second the driving pattern changes causing certain segments to change length by a discrete amount; in the second mode, all segments retain their most recent length. All the driving patterns described above are derived from the first of the 12 data sets (i.e., they correspond to a common drive motif). If button 112 is again pushed, held for approximately 0.2 seconds, then released, a new data set will be selected, generating an entirely new motif that may be similarly manipulated as outlined above; additional about-2-second-long pushes cyclically activate each of the 12 data sets in this exemplary embodiment. Motifs generated by different data sets may produce obviously dissimilar light displays, with each data set exhibiting a characteristic color scheme. In this exemplary embodiment there are eight degrees of modification through which the length-changing trends progress, hence, each of the aforementioned 12 data sets yields 8 driving patterns, for a total of 96 different time-dependent driving signals in this exemplary embodiment. When finished using the apparatus, the user may return the circuit to the powered down state by pushing and holding for 5 seconds button 112 in FIG. 1.

Some of these driving patterns can create the illusion of motion when, for example, the repeating period of the driving pattern is slightly longer than the period of revolution of light source 100 around a closed or nearly closed path which is most preferably substantially circular or elliptical. In the particular case of a circular path, the light display can be made to appear to slowly rotate along the circle in the same direction that light source 100 moves (albeit more rapidly). As the operator gradually slows light source 100, the rotation of the light display will slow down until it appears to be motionless, and then will begin to rotate in the opposite direction. Other driving patterns may generate other motifs, which contain one or more repeating elements, which may be more complex than motif 300 in FIG. 4. Such driving patterns can generate light displays in which certain colored segments exhibit the slow rotation described above while other elements in the motif appear stationary or fixed within the light display. Driving patterns that generate two sets of periodic pulses having different temporal periods can be used to produce displays wherein different parts of the display simultaneously move in opposing directions according to the operator's control.

The light displays described above belong to a family of what may be called dynamic light displays: light displays which exhibit illusionary movement, as controlled by the operator's adjusting the speed or frequency of revolution of light source 100 along a substantially closed path. Stroboscopic driving patterns, which flash light source 100, can be used to make especially striking dynamic light displays in which the phenomenon of illusionary movement can be used to obtain the greatest visual effect.

In another embodiment of the present invention, other button-push sequences, button types, and/or button configurations may be used to control the execution of coded instructions of functional equivalence to those in Appendix 1, including but not limited to: different push-button holding-times; multiple, rapid, button-pushes; on-off buttons or switches; multiple buttons or switches; functional equivalents thereof; and/or combinations thereof.

In another embodiment of the present invention, any set of at least one light source may be employed to produce a display substantially similar to that illustrated in FIG. 4 when the source is moved as in FIG. 3. In another embodiment of the present invention, any functionally equivalent light source may be employed wherein one or more sources may be driven so as to produce a display of bright segments of the type depicted in FIG. 4 when the source is moved as in FIG. 3. Such light sources may include but are not limited to: light-emitting-diode sources, laser diode sources; other laser sources; stroboscopic sources; incandescent sources; fluorescent sources; phosphorescent sources; functional equivalents thereof; and/or combinations thereof. In another embodiment of the present invention, one or more additional discrete light sources may be placed along tether 108 in FIG. 1, thereby creating displays in which at least one additional set of curvilinear segments may appear in a light display such as the one illustrated in FIG. 4. In another embodiment of the present invention, light may be generated by any of the means recited above, then delivered to the discrete location of light source 100 through a fiber-optic cable or functionally equivalent "light-piping" member.

In another embodiment of the present invention, the data sets described above and used, as in Appendix 1, to program IC1 in FIG. 2, may be modified to produce additional driving patterns that may be used to produce additional light displays. Differing numbers of data sets may be employed. In another embodiment of the present invention, any microcontroller or microprocessor may be used to perform some or all of the functions of IC1 in FIG. 2. In another embodiment of the present invention, IC1, or its functional equivalent, in FIG. 2 may be programmed with any code which functions as does that in Appendix 1 to generate light displays of substantial equivalence to that in FIG. 4. In another embodiment of the present invention, the means for generating driving patterns to drive a light source so as to produce light displays substantially equivalent to that indicated in FIG. 4 may comprise any means functionally equivalent to the driving circuitry depicted in FIG. 2, including but not limited to: an addressable, readable electronic memory, containing data which may be decoded to generate driving patterns, sequentially addressed by a counter chip; arrays of logic gates driven through various states by a clocked counter chip; arrays of clocked flip-flops and logic gates in a state machine configuration; and pluralities of synchronized oscillators. In another embodiment of the present invention, multiple circuits of functional equivalence to the driving circuitry depicted in FIG. 2 may be used in parallel to produce displays substantially equivalent to those indicated in FIG. 4. In another embodiment of the present invention, driving patterns with no visually obvious periodicity or motif may be generated with: logic gates in combination with shift registers; at least two unsynchronized primary drive signals; or with any means adapted to generate time varying electronic signals that do not repeat or that have long repeat periods.

In another embodiment, one or more electromechanical switches and/or other control actuator(s) may be used with any combination of the aforementioned driving circuits to control the production of a series of light displays having substantial equivalence to the light display in FIG. 4, in ways including but not limited to: changing the length of one or more of the segments; changing the color of one or more of the segments; changing the brightness level of one or more of the segments (including making the segment dark); changing the order in which the segments appear along the curvilinear path. In another embodiment of the present invention, one or more electromechanical switches and/or other control actuator(s) may provide the operator direct control over power delivery to the light source, whereby displays substantially equivalent to that of FIG. 4, though possibly lacking a motif, may be generated. In another embodiment of the present invention, the operator may control or select driving patterns to generate light displays substantially equivalent to that of FIG. 4 by means of any one or more control actuators and/or control devices and/or combinations thereof including but not limited to: electromechanical switches and/or other electromechanical devices; potentiometers, variable resistors, and/or rheostats; acoustic switches; optical switches; switches driven by an acceleration-sensing device; switches driven by a motion-sensing device; functional equivalents thereof; and/or combinations thereof. Such control actuator(s) may be located on the handle, or in any other suitable location for enabling actuation thereof without substantially interrupting movement of the light source. In another embodiment of the present invention, a circuit functionally equivalent to the circuit in FIG. 2 may also include electromagnetic coupling, or "remote control", of circuit elements.

In another embodiment of the present invention, light source 100 may be connected to handle/circuit-enclosure 106 by any suitable flexible tether including but not limited to: a compression or tension spring; a compression or tension coil; an elongated rod or wand made of plastic, metal, wood, or a composite material; a length of string, wire, cable, chain, fabric, or leather; a "Chinese yo-yo" made by rolling or coiling a ribbon-like material; functional equivalents thereof; and/or combinations thereof. In another embodiment of the present invention, tether 108 may be of any length and have any flexibility/rigidity such that a human operator may produce displays substantially analogous to FIG. 4. In another embodiment of the present invention, tether 108 may be hollow so that wire 104 may run through tether 108. In another embodiment of the present invention, all or a portion of the drive circuit may be placed in an enclosure with the light source, or in some other suitable arrangement, provided such arrangement allows the user to select driving patterns without substantially interrupting movement of the light source.

In another embodiment of the present invention, a circuit functionally equivalent to the circuit in FIG. 2 may include voltage converting and/or regulating means, and may be driven by any suitable power supply. In another embodiment of the present invention, the power supply may be an electric generator which is mechanically driven by the operator of the apparatus, including, but not limited to, a generator driven by the torque associated with the above described hand motions (which may be substantially circular, elliptical, or oval) of the operator.

It is intended that modifications to the disclosed embodiments may be made without departing from inventive concepts disclosed and/or claimed herein.

APPENDIX

Set forth hereinbelow is an exemplary set of programming instructions for controlling a light display as disclosed and/or claimed herein.

```
:10000000A70BE2010C080E080E080F080F080A08DB
:100010000A080F080F08060806080F080F08060848
:100020000E080E0800080008060806080C080E084E
:100030008D080C088B080A08890808088708060834
:1000400085080408830804080E080C080F080A082D
:1000500006080B080F0807080F0803080F08070811
:100060000E080E08A408E608A4080C080C084108AD
:10007000EE080F08EC080F08EA080F08E8080F0858
:10008000E6080F08E4080F08CE084F08CC084F0810
:10009000CA084F08C8084F08C6084F08C4084F08C8
:1000A0008E088F088C088F088A088F0888088F08A8
:1000B00086088F0884088F084E08CF084C08CF08A0
:1000C0004A08CF084808CF084608CF084408CF0898
:1000D0000E080C080A080808060804080F080F088C
:1000E0000F080F080F080F080F080F080F080F0858
:1000F0000F080C08F4080F08F6080F08F8080F0896
:10010000FA080F08FC080F08FE080F081708EA088D
:100110002708EF08EA084F08CD08EA086D08A70885
:10012000EA0887088F08EA08AF086D08EA08CD08D2
:100130004708EA08E7082F08EA080D082708030817
```

APPENDIX-continued

Set forth hereinbelow is an exemplary set of programming instructions for controlling a light display as disclosed and/or claimed herein.

```
:100140000F0803080F0803080F0803080F08030827
:100150000F0803080F0803080F0803080F08030817
:100160000F080F0808080F0808080F0808080F08EC
:1001700008080F0808080F0808080F0808080F08E3
:1001800008080F0808080F0808080F082D080C08B1
:100190000C080C08BE08BA08B608BE08BA08B608AB
:1001A000BE08BA08B608BE08BA08B60808080808A3
:1001B0000808BE08BA08B608BE08BA08B608BE08DD
:1001C000BA08B608BE08BA08B60804080408040845
:1001D000BE08BA08B608BE08BA08B608BE08BA080B
:1001E000B608BE08BA08B60803081D0803087C084C
:1001F000670068006900E900090B04006607FD0A52
:100200006A006B006C00EA03030B0400EB03030BB2
:10021000A80BFE0C26006A006B006C00070C6E0138
:10022000A9020902C70127000109290068008A802E4
:100230005004AB07270B1006EE00070C6E01200CD4
:10024000EB010307270BAC02EC07270BFD0A0E029C
:10025000400D02000902E80208022800C701010956
:10026000B0042F0021002103410421040104 8F0761
:10027000410BCF0DFF0F070C43074E02070E400D39
:1002800002008F050F022400E403470B6C0BB0063D
:10029000180B0400040C2D00000284062600E10661
:1002A000B005A402F40C8400110C430624000000E5
:1002B0000000ED024C0B0F022400A402FE0C2600ED
:1002C0006607850BF007670B6A006B006C00F00493
:1002D000AB02EA03EB00470BB006180B0A0C2D002B
:1002E000FE0C2600000000000400E106B005ED024F
:1002F000700B6607850BF007800B6A006B006C00C3
:10030000F004AB02EA03EB006C0BAC02EA03EC0076
:10031000CC06FD0AF006410BF0056A006B006C008C
:10032000EA03900B0400AB026B07900B6606410BCF
:100330006B00EA03990B0400AC02EB03EC000C0722
:10034000990B6606090B6B00B0023004410B2500C7
:10035000320C2600CC0C0600400C02006100E107C4
:10036000AF0B0400660603000400470C0200CC0C2F
:100370000600300C3100340035003600 3F00220CFE
:1003800032003B003C003D003E00120C33003700C1
:100390003800390 03A0004006607CB0B670068009C
:1003A0006900E9006A006B0070000400090BA80BEB
:021FFE00E60FEC
:00000001FF
```

What is claimed is:

1. An apparatus for producing multiple light displays, comprising:

at least one discrete light source emitting at least one primary color;

a drive circuit for driving the light source with a time-dependent drive signal selected from a plurality of time-dependent drive signals;

a flexible tether secured near a first end thereof to the light source;

a handle, secured to the flexible tether near a second end thereof, for enabling a user to move the light source along a curvilinear path at the second end of the tether, the selected time-dependent drive signal and movement of the light source together producing one of the multiple light displays; and at least one control actuator for enabling the user, while moving the light source along the curvilinear path and without substantially interrupting movement of the light source, to perform at least one of (i) altering the time-dependence of the drive signal and (ii) selecting another of the plurality of time-dependent drive signals for driving the light source, thereby altering the light display;

wherein:

the light source comprises a plurality of light emitting elements, each light-emitting element emitting one of the primary colors;

the light-emitting elements are arranged so that at least two emitted primary colors may appear to a human observer as an emitted secondary color, the secondary color being determined by relative brightness levels of the emitted primary colors; and wherein the brightness level of each primary color is determined at least in part by a duty cycle of a corresponding oscillatory primary drive signal, each oscillatory primary drive signal oscillating sufficiently rapidly, during a temporal interval in which the secondary color appears to be emitted, so that the secondary color appears to the human observer to be emitted substantially continuously during said temporal interval.

2. The apparatus of claim 1, wherein each oscillatory primary drive signal oscillates at a frequency greater than about 7 kHz.

3. The apparatus of claim 1, wherein each light-emitting element comprises a light-emitting diode.

4. An apparatus for producing multiple light displays, comprising:

at least one discrete light source emitting at least one primary color;

a drive circuit for driving the light source with a time-dependent drive signal selected from a plurality of time-dependent drive signals;

a flexible tether secured near a first end thereof to the light source;

a handle, secured to the flexible tether near a second end thereof, for enabling a user to move the light source along a curvilinear path at the second end of the tether, the selected time-dependent drive signal and movement of the light source together producing one of the multiple light displays; and at least one control actuator for enabling the user, while moving the light source along the curvilinear path and without substantially interrupting movement of the light source, to perform at least one of (i) altering the time-dependence of the drive signal and (ii) selecting another of the plurality of time-dependent drive signals for driving the light source, thereby altering the light display;

wherein each of the plurality of time-dependent drive signals comprises multiple primary drive signals, each primary drive signal corresponding to one of the primary colors and each primary color having a corresponding one of the primary drive signals, at least one of the multiple primary drive signals comprising a repeated primary drive motif, said primary drive motif comprising at least one temporal interval when the primary color is emitted at a first brightness level and at least one temporal interval when the primary color is emitted at a second brightness level, ratios of lengths of the temporal intervals within a primary drive motif being substantially time-independent.

5. The apparatus of claim 4, wherein the selected time-dependent drive signal and movement of the light source along the curvilinear path result in a light display including at least two segments of the curvilinear path, each segment being one of a dark segment, a primary color segment, and a secondary color segment, the segments appearing along the curvilinear path, the light-emitting elements being arranged so that at least two emitted primary colors may appear to a human observer as an emitted secondary color, the secondary color being determined by relative brightness levels of the emitted primary colors.

6. The apparatus of claim 5, wherein at least one segment appears to move along the curvilinear path.

7. The apparatus of claim 5, wherein the drive circuit is adapted for altering the temporal length of at least one primary drive motif in response to user actuation of the control actuator without substantially altering ratios of lengths of the temporal intervals within the primary drive motif and without substantially interrupting movement of the light source along the curvilinear path.

8. The apparatus of claim 7, wherein altering the temporal length of at least one drive motif enables the user to alter at least one of speed and direction of apparent motion of at least one segment along the curvilinear path.

9. The apparatus of claim 5, wherein the drive circuit is adapted for switching at least one of the primary drive signals to a differing primary drive motif in response to user actuation of the control actuator, thereby enabling the user to select another of the plurality of time-dependent drive signals without substantially interrupting movement of the light source along the curvilinear path.

10. The apparatus of claim 4, wherein the light source comprises a plurality of light emitting elements, each light-emitting element emitting one of the primary colors.

11. The apparatus of claim 10, wherein each light-emitting element comprises a light-emitting diode.

12. An apparatus for producing multiple light displays, comprising:

at least one discrete light source emitting at least one primary color;

a drive circuit for driving the light source with a time-dependent drive signal selected from a plurality of time-dependent drive signals;

a flexible tether secured near a first end thereof to the light source;

a handle, secured to the flexible tether near a second end thereof, for enabling a user to move the light source alone a curvilinear path at the second end of the tether, the selected time-dependent drive signal and movement of the light source together producing one of the multiple light displays; and at least one control actuator for enabling the user, while moving the light source along the curvilinear path and without substantially interrupting movement of the light source, to perform at least one of (i) altering the time-dependence of the drive signal and (ii) selecting another of the plurality of time-dependent drive signals for driving the light source, thereby altering the light display;

wherein:

the drive circuit is programmable and encoded with instructions for producing each of the plurality of time-dependent drive signals;

the drive circuit includes memory for storing digitally encoded instructions for producing each of the time-dependent drive signals; and the digitally encoded instructions include a plurality of data sets, each data set corresponding to a respective drive motif, each drive motif corresponding to a group of related ones of the plurality of time-dependent drive signals, each drive motif comprising multiple temporal intervals, each temporal interval differing from at least one other of the temporal intervals of the drive motif with respect to a brightness level of at least one of the primary colors, each one of the drive motifs and movement of the light source along the curvilinear path resulting in a light display including at least two segments of the curvilinear path, each segment being one of a dark segment, a primary color segment, and a secondary color segment, the segments appearing along the curvilinear path, the light-emitting elements being arranged so that at least two emitted primary colors may appear to a human observer as an emitted secondary color, the secondary color being determined by relative brightness levels of the emitted primary colors.

13. The apparatus of claim 12, wherein the drive circuit is adapted for switching, in response to user actuation of the control actuator, from one time-dependent drive signal of the group of related ones of the time-dependent drive signals to another time-dependent drive signal of said group, thereby enabling the user to alter the light display without substantially interrupting movement of the light source.

14. The apparatus of claim 12, wherein the drive circuit is adapted for switching, in response to user actuation of the control actuator, from one of the plurality of data sets to another of the plurality of data sets, thereby enabling the user to switch from one group of related ones of the plurality of time-dependent drive signals to another group of related ones of the plurality of time-dependent drive signals and alter the light display without substantially interrupting movement of the light source.

15. The apparatus of claim 12, wherein the light source comprises a plurality of light emitting elements, each light-emitting element emitting one of the primary colors.

16. The apparatus of claim 15, wherein each light-emitting element comprises a light-emitting diode.

17. A method for producing multiple light displays, comprising:

providing an apparatus to a user, the apparatus comprising at least one discrete light source emitting at least one primary color, a drive circuit for driving the light source with a time-dependent drive signal selected from a plurality of time-dependent drive signals, a flexible tether secured near a first end thereof to the light source, a handle, secured to the flexible tether near a second end thereof, for enabling a user to move the light source along a curvilinear path at the second end of the tether, the selected time-dependent drive signal and movement of the light source together producing one of the multiple light displays, and at least one control actuator for enabling the user, while moving the light source along the curvilinear path and without substantially interrupting movement of the light source, to perform at least one of (i) altering the time-dependence of the drive signal and (ii) selecting another of the plurality of time-dependent drive signals for driving the light source, thereby altering the light display;

instructing the user to hold the handle, activate the light source, and move the light source along a curvilinear path, thereby producing the light display; and instructing the user to actuate the control actuator while moving the light source along the curvilinear path, thereby altering the light display without substantially interrupting the movement of the light source, wherein:

the light source comprises a plurality of light emitting elements, each light-emitting element emitting one of the primary colors;

the light-emitting elements are arranged so that at least two emitted primary colors may appear to a human observer as an emitted secondary color, the secondary color being determined by relative brightness levels of the emitted primary colors; and the brightness level of each primary color is determined at least in part by a duty cycle of a corresponding oscillatory primary drive signal, each oscillatory primary drive signal oscillating sufficiently rapidly, during a temporal interval in which the secondary color appears to be emitted, so that the secondary color appears to the human observer to be emitted substantially continuously during said temporal interval.

18. The method of claim 17, wherein each oscillatory primary drive signal oscillates at a frequency greater than about 7 kHz.

19. The method of claim 17, wherein each light-emitting element comprises a light-emitting diode.

20. A method for producing multiple light displays, comprising;

providing an apparatus to a user, the apparatus comprising at least one discrete light source emitting at least one primary color;

a drive circuit for driving the light source with a time-dependent drive signal selected from a plurality of time-dependent drive signals;

a flexible tether secured near a first end thereof to the light source, a handle, secured to the flexible tether near a second end thereof, for enabling a user to move the light source along a curvilinear path at the second end of the tether, the selected time-dependent drive signal and movement of the light source together producing one of the multiple light displays, and at least one control actuator for enabling the user, while moving the light source along the curvilinear path and without substantially interrupting movement of the light source, to perform at least one of (i) altering the time-dependence of the drive signal and (ii) selecting another of the plurality of time-dependent drive signals for driving the light source, thereby altering the light display;

instructing the user to hold the handle, activate the light source, and move the light source along a curvilinear path, thereby producing the light display; and instructing the user to actuate the control actuator while moving the light source along the curvilinear path, thereby altering the light display without substantially interrupting the movement of the light source;

wherein each of the plurality of time-dependent drive signals comprises multiple primary drive signals, each primary drive signal corresponding to one of the primary colors and each primary color having a corresponding one of the primary drive signals, at least one of the multiple primary drive signals comprising a repeated primary drive motif, said primary drive motif comprising at least one temporal interval when the primary color is emitted at a first brightness level and at least one temporal interval when the primary color is emitted at a second brightness level, ratios of lengths of the temporal intervals within a primary drive motif being substantially time-independent.

21. The method of claim 20, wherein the selected time-dependent drive signal and movement of the light source along the curvilinear path result in a light display including at least two segments of the curvilinear path, each segment being one of a dark segment, a primary color segment, and a secondary color segment, the segments appearing along the curvilinear path, the light-emitting elements being arranged so that at least two emitted primary colors may appear to a human observer as an emitted secondary color, the secondary color being determined by relative brightness levels of the emitted primary colors.

22. The method of claim 21, wherein at least one segment appears to move along the curvilinear path.

23. The method of claim 21, wherein the drive circuit is adapted for altering the temporal length of at least one primary drive motif in response to user actuation of the control actuator without substantially altering ratios of lengths of the temporal intervals within the primary drive motif and without substantially interrupting movement of the light source along the curvilinear path.

24. The method of claim 23, wherein altering the temporal length of at least one drive motif enabling enables the user to alter at least one of speed and direction of apparent motion of at least one segment along the curvilinear path.

25. The method of claim 21, wherein the drive circuit is adapted for switching at least one of the primary drive signals to a differing primary drive motif in response to user actuation of the control actuator, thereby enabling the user to select another of the plurality of time-dependent drive signals without substantially interrupting movement of the light source along the curvilinear path.

26. The method of claim 20, wherein the light source comprises a plurality of light emitting elements, each light-emitting element emitting one of the primary colors.

27. The method of claim 26, wherein each light-emitting element comprises a light-emitting diode.

28. A method for producing multiple light displays, comprising:

providing an apparatus to a user, the apparatus comprising at least one discrete light source emitting at least one primary color;

a drive circuit for driving the light source with a time-dependent drive signal selected from a plurality of time-dependent drive signals, a flexible tether secured near a first end thereof to the light source, a handle, secured to the flexible tether near a second end thereof, for enabling a user to move the light source along a curvilinear path at the second end of the tether, the selected time-dependent drive signal and movement of the light source together producing one of the multiple light displays, and at least one control actuator for enabling the user, while moving the light source alone the curvilinear path and without substantially interrupting movement of the light source, to perform at least one of (i) altering the time-dependence of the drive signal and (ii) selecting another of the plurality of time-dependent drive signals for driving the light source, thereby altering the light display;

instructing the user to hold the handle, activate the light source, and move the light source along a curvilinear path, thereby producing the light display; and instructing the user to actuate the control actuator while moving the light source along the curvilinear path, thereby alerting the light display without substantial interrupting the movement of the light source, wherein:

the drive circuit is programmable and encoded with instructions for producing each of the plurality of time-dependent drive signals;

the drive circuit includes memory for storing digitally encoded instructions for producing each of the time-dependent drive signals; and the digitally encoded instructions include a plurality of data sets, each data set corresponding to a respective drive motif, each drive motif corresponding to a group of related ones of the plurality of time-dependent drive signals, each drive motif comprising multiple temporal intervals, each temporal interval differing from at least one other of the temporal intervals of the drive motif with respect to a brightness level of at least one of the primary colors, each one of the drive motifs and movement of the light source along the curvilinear path resulting in a light display including at least two segments of the curvilinear path, each segment being one of a dark segment, a primary color segment, and a secondary color segment, the segments appearing along the curvilinear path, the light-emitting elements being arranged so that at least two emitted primary colors may appear to a human observer as an emitted secondary color, the secondary color being determined by relative brightness levels of the emitted primary colors.

29. The method of claim 28, wherein the drive circuit is adapted for switching, in response to user actuation of the control actuator, from one time-dependent drive signal of the group of related ones of the time-dependent drive signals to another time-dependent drive signal of said group, thereby enabling the user to alter the light display without substantially interrupting movement of the light source.

30. The method of claim 28, wherein the drive circuit is adapted for switching, in response to user actuation of the control actuator, from one of the plurality of data sets to another of the plurality of data sets, thereby enabling the user to switch from one group of related ones of the plurality of time-dependent drive signals to another group of related ones of the plurality of time-dependent drive signals and alter the light display without substantially interrupting movement of the light source.

31. The method of claim 28, wherein the light source comprises a plurality of light emitting elements, each light-emitting element emitting one of the primary colors.

32. The method of claim 31, wherein each light-emitting element comprises a light-emitting diode.

* * * * *